United States Patent [19]

Etchegoyhen

[11] 3,961,791

[45] June 8, 1976

[54] RACING GAME

[75] Inventor: Pedro Etchegoyhen, Chicago, Ill.

[73] Assignee: The Raymond Lee Organization, Inc., New York, N.Y. ; a part interest

[22] Filed: Nov. 18, 1974

[21] Appl. No.: 524,617

[52] U.S. Cl. ..... 273/86 B; 46/240; 46/251

[51] Int. Cl.[2] ..... A63F 9/14

[58] Field of Search ..... 273/86 B, 1 M; 46/210, 46/240, 202, 243 LV

[56] References Cited

UNITED STATES PATENTS

| | | | |
|---|---|---|---|
| 1,447,363 | 3/1923 | Tozier | 273/86 B |
| 1,533,540 | 4/1925 | Craigen | 273/86 B |
| 2,441,060 | 5/1948 | Cunningham | 273/86 B |
| 3,091,459 | 5/1963 | Lindman | 273/1 M X |
| 3,753,313 | 8/1973 | Bross | 46/202 |
| 3,810,515 | 5/1914 | Ingro | 46/243 LV UX |

*Primary Examiner*—Anton O. Oechsle
*Attorney, Agent, or Firm*—Howard I. Podell

[57] ABSTRACT

A racing game, in which motorized wheeled racing objects in the form of horses are each steered about the marked race course by individual hand-held magnetic tipped rods held by the players under the game board. The wheeled race horses are individually fitted with magnets or magnetic-attractable blocks mounted under the base of each race horse and located between the wheels. A wheel of each race horse is driven by a battery powered electric motor.

2 Claims, 5 Drawing Figures

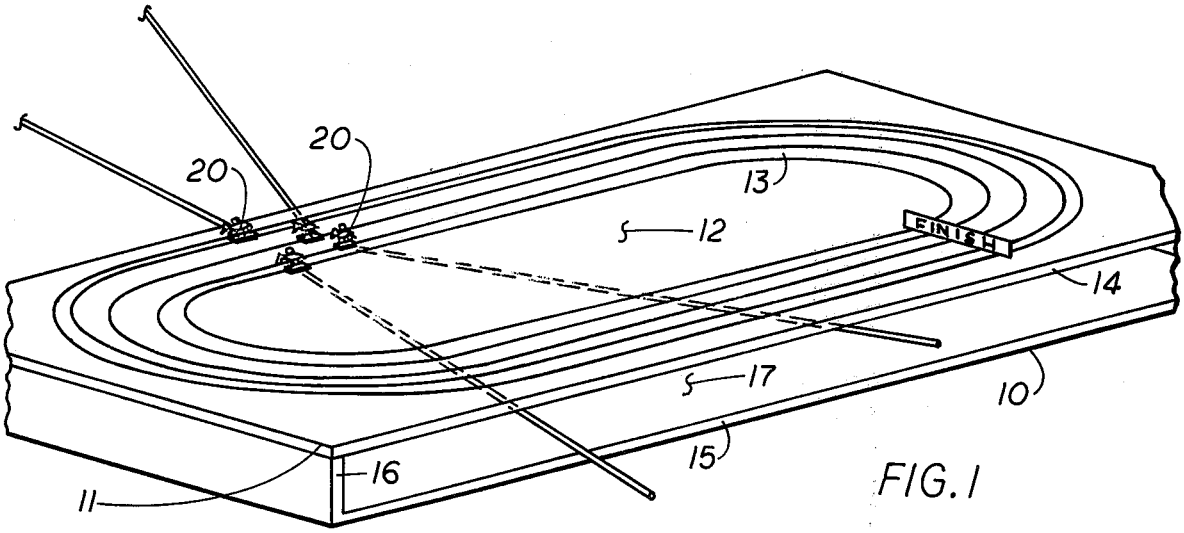
FIG. 1
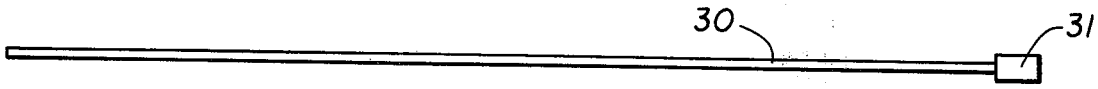
FIG. 2
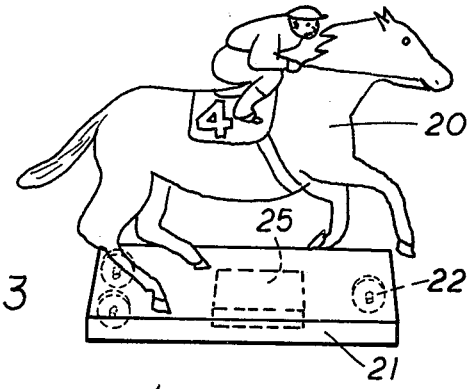
FIG. 3
FIG. 4
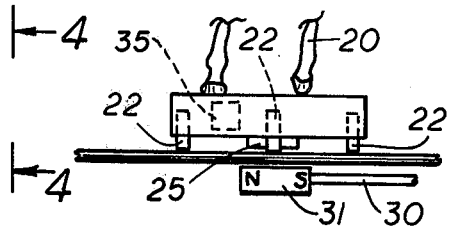
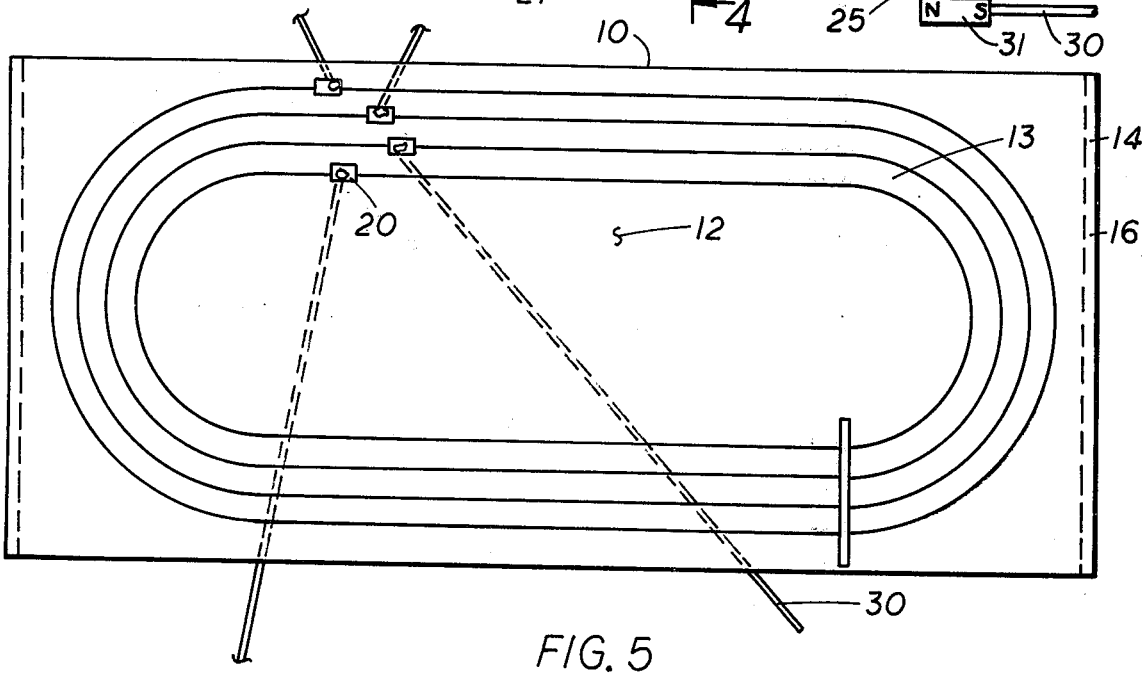
FIG. 5

RACING GAME

SUMMARY OF THE INVENTION

A racing game, in which motorized wheeled racing objects in the form of horses are each steered about the marked race course by individual hand-held magnetic tipped rods held by the players under the game board, with each player able to steer his horse into or out of the lanes of the race course.

The wheeled race horses are individually fitted with magnets or magnetic-attractable blocks mounted under the base of each race horse and located between the wheels.

A wheel of each race horse is driven by a battery powered electric motor.

DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention;

FIG. 2 is a plan view of a player's steering rod;

FIG. 3 is a perspective view of a racer;

FIG. 4 is a rear view of the base of the racer, taken along line 4—4 of FIG. 3; and FIG. 5 is a plan view of the invention.

DESCRIPTION OF THE PREFERRED EMBODIMENT

Turning now descriptively to the drawings, in which similar reference characters denote similar elements throughout the several views, FIGS. 1–5 illustrate the game 10 which includes a game board 11, the upper surface 12 of which is marked as an oval shaped race course with individual lanes 13 delineated. The upper board 14 of the game board 11 is elevated above the base 15 by end supports 16 so as to create a space 17, open to the sides of the board, under the upper board 14.

Each racer, 20 in the form of a horse is mounted on a base 21 with three wheels 22, one of which may be driven by a spring or battery-powered motor 35. A magnet 25 or magnetically attractable block is mounted to the base 21.

Each player utilizes a rod 30, an end of which is fitted with a magnet 31 and the individual players manipulate their rods, under the top board 14, to steer their racer 20 along the race course as the racer is propelled by the motor-driven wheel 22 of the racer 20. The players may manipulate their rod 30 to steer their racers into and out of the various lanes 13 of the race course as desired.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A racing game comprising a game board mounted on supports so as to provide space under the board that is open to the sides of the board, the upper surface of said board being marked in a pattern of racing lanes, a plurality of wheeled, motor-driven racing objects, with each racing object fitted in its base with a magnetically attractable block, and a plurality of rods, each of which is utilized by a player to steer his racing object, with one end of each rod tipped with a block that is magnetically attractable to the block in the base of a racing object, with the magnetically attractable block fitted in the base of each racing object located so as to be magnetically attracted when the racing object is mounted in the erect position on the game board, by a said tipped end of the rod positioned under the game board opposite the said block so as to permit steering of the racing object, in motor-driven motion, by manual manupulation of the rod, without direct physical contact between the rod and the racing object.

2. The combination as recited in claim 1 in which the racing objects are each mounted on three wheels.

* * * * *